US006592201B2

(12) United States Patent
Sharma et al.

(10) Patent No.: US 6,592,201 B2
(45) **Date of Patent: *Jul. 15, 2003**

(54) CLEANING ORIFICES IN INK JET PRINTING APPARATUS

(75) Inventors: Ravi Sharma, Fairport, NY (US); Kwok L. Yip, Webster, NY (US); Christopher N. Delametter, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/939,868

(22) Filed: Aug. 27, 2001

(65) Prior Publication Data

US 2002/0140762 A1 Oct. 3, 2002

Related U.S. Application Data

(63) Continuation-in-part of application No. 09/159,447, filed on Sep. 24, 1998, now Pat. No. 6,281,707.

(51) Int. Cl.[7] ..... B41J 2/165
(52) U.S. Cl. ..... 347/28
(58) Field of Search ..... 347/22, 28, 34, 347/33

(56) References Cited

U.S. PATENT DOCUMENTS

| | | | | |
|---|---|---|---|---|
| 3,373,437 A | | 3/1968 | Sweet et al. | |
| 3,416,153 A | | 12/1968 | Hertz et al. | |
| 3,705,043 A | | 12/1972 | Zabiak | |
| 3,776,642 A | | 12/1973 | Anson et al. | |
| 3,846,141 A | | 11/1974 | Ostergren et al. | |
| 3,870,528 A | | 3/1975 | Edds et al. | |
| 3,878,519 A | | 4/1975 | Eaton | |
| 3,889,269 A | | 6/1975 | Meyer et al. | |
| 3,903,034 A | | 9/1975 | Zabiak et al. | |
| 4,346,387 A | | 8/1982 | Hertz | |
| 4,849,769 A | | 7/1989 | Dressler | |
| 5,005,024 A | | 4/1991 | Takahashi et al. | |
| 5,305,015 A | | 4/1994 | Schantz et al. | |
| 5,350,616 A | | 9/1994 | Pan et al. | |
| 5,426,458 A | | 6/1995 | Wenzel et al. | |
| 5,431,722 A | | 7/1995 | Yamashita et al. | |
| 5,725,647 A | | 3/1998 | Carlson et al. | |
| 5,738,716 A | | 4/1998 | Santilli et al. | |
| 5,914,734 A | | 6/1999 | Rotering et al. | |
| 5,997,127 A | | 12/1999 | Fassler et al. | |
| 6,047,715 A | * | 4/2000 | Mooney et al. | 134/122 R |
| 6,281,909 B1 | | 8/2001 | Fassler et al. | |

FOREIGN PATENT DOCUMENTS

| | | |
|---|---|---|
| GB | 2 319 221 A | 5/1998 |

* cited by examiner

*Primary Examiner*—Huan Tran
(74) *Attorney, Agent, or Firm*—Roland R. Schindler, II

(57) ABSTRACT

An ink jet printer is provided having a printhead defining a plurality of orifices for ejecting ink droplets. The printer comprises a source of cleaning fluid, a cleaning member having a surface partially dipped in the cleaning fluid, a first drive mechanism to move the cleaning member surface creating a flow of cleaning fluid on the surface and a second drive mechanism to advance the printhead and the cleaning member surface into a proximate and separate relation with the cleaning member surface wherein at least one of the orifices of the printhead enters the flow of cleaning fluid wherein the print head and the cleaning member surface are separated by gap of between 0.1 mm and 2.54 mm.

28 Claims, 9 Drawing Sheets

Fig. 1
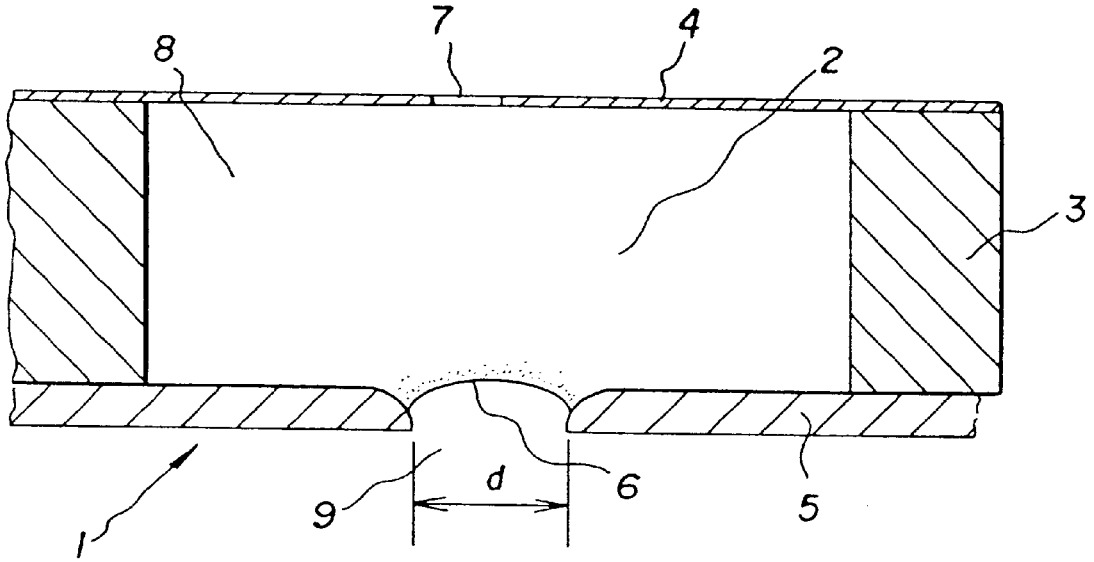
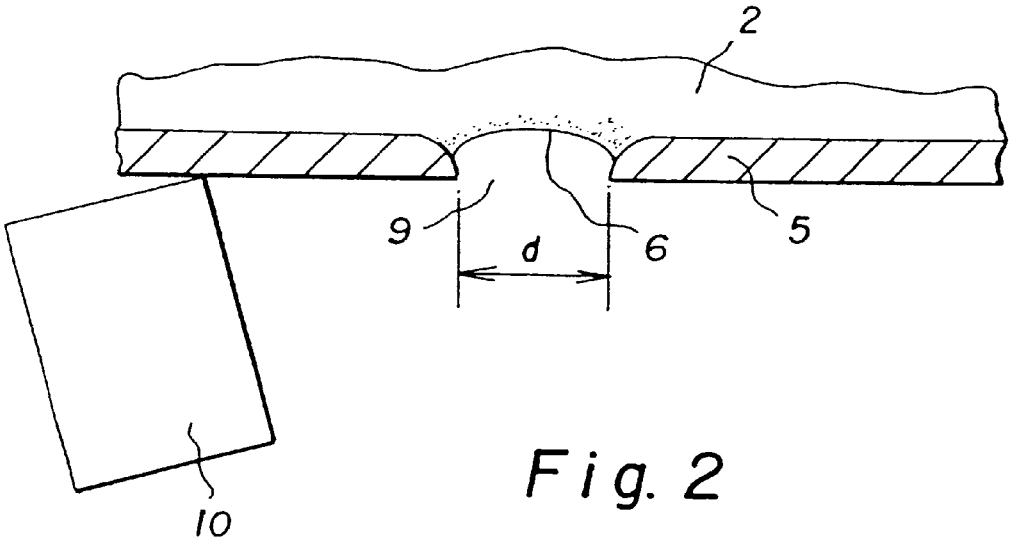
Fig. 2

Fig. 3
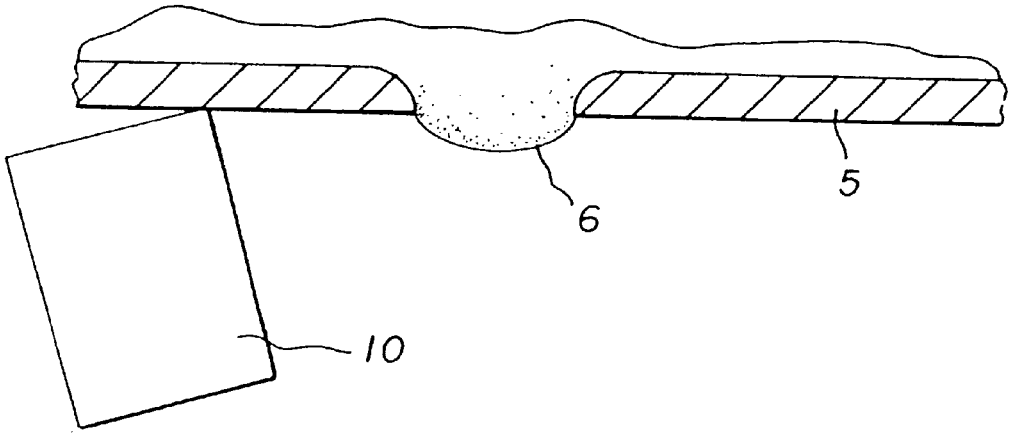
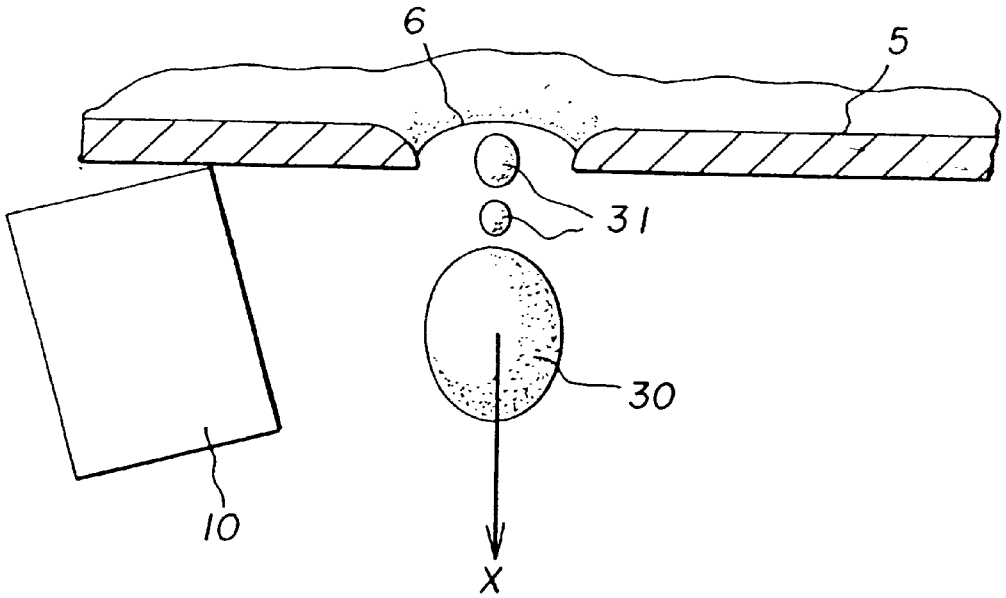
Fig. 4

CLEANING ORIFICES IN INK JET PRINTING APPARATUS

CROSS REFERENCE TO RELATED APPLICATIONS

This is a Continuation-In-Part of application Ser. No. 09/159,447 filed Sep. 24, 1998 now U.S. Pat. No. 6,281,707 entitled CLEANING ORIFICES IN INK JET PRINTING APPARATUS by Fassler et al.

Reference is also made to commonly assigned U.S. Pat. No. 5,997,127 filed Sep. 24, 1998 entitled ADJUSTABLE VANE USED IN CLEANING ORIFICES IN INKJET PRINTING APPARATUS to Werner Fassler et al., the disclosure of which is incorporated herein by reference.

FIELD OF THE INVENTION

This invention relates to the cleaning of ink jet print head apparatus having multiple orifices.

BACKGROUND OF THE INVENTION

Many different types of digitally controlled printing systems of ink jet printing apparatus are presently being used. These ink jet printers use a variety of actuation mechanisms, a variety of marking materials, and a variety of recording media. For home applications, digital ink jet printing apparatus is the printing system of choice because low hardware cost makes the printer affordable to every one. Another application for digital inkjet printing uses large format printers. It is a further requirement that these large format printers provide low cost copies with an ever improving quality. Ink jet printing technology is the first choice in today's art. Thus, there is a need for improved ways to make digitally controlled graphic arts media, such as billboards, large displays, and home photos for example, so that quality color images may be made at a high-speed and low cost, using standard or special paper.

Ink jet printing has become recognized as a prominent contender in the digitally controlled, electronic printing arena because of its nonimpact, low-noise characteristics, its use of papers from plain paper to specialized high gloss papers and its avoidance of toner transfers and fixing. Inkjet printing mechanisms can be categorized as either continuous inkjet or droplet on demand ink jet. Continuous inkjet printing dates back to at least 1929. See U.S. Pat. No. 1,941,001 to Hansell.

U.S. Pat. No. 3,373,437, issued to Sweet et al. in 1967, discloses an array of continuous inkjet orifices wherein ink droplets to be printed are selectively charged and deflected towards the recording medium. This technique is known as binary deflection continuous inkjet, and is used by several manufacturers, including Elmjet and Scitex.

U.S. Pat. No. 3,416,153, issued to Hertz et al. in 1966, discloses a method of achieving variable optical density of printed spots in continuous inkjet printing using the electrostatic dispersion of a charged droplet stream to modulate the number of droplets which pass through a small orifice. This technique is used in ink jet printers manufactured by Iris.

U.S. Pat. No. 3,878,519, issued to Eaton in 1974, discloses a method and apparatus for synchronizing droplet formation in a liquid stream using electrostatic deflection by a charging tunnel and deflection plates.

U.S. Pat. No. 4,346,387, issued to Hertz in 1982 discloses a method and apparatus for controlling the electric charge on droplets formed by the breaking up of a pressurized liquid stream at a droplet formation point located within the electric field having an electric potential gradient. Droplet formation is effected at a point in the field corresponding to the desired predetermined charge to be placed on the droplets at the point of their formation. In addition to charging tunnels, deflection plates are used to actually deflect droplets.

Conventional continuous ink jet utilizes electrostatic charging tunnels that are placed close to the point where the droplets are formed in a stream. In this manner individual droplets may be charged. The charged droplets may be deflected downstream by the presence of deflector plates that have a large potential difference between them. A gutter (sometimes referred to as a "catcher") may be used to intercept the charged droplets, while the uncharged droplets are free to strike the recording medium. If there is no electric field present or if the break off point from the droplet is sufficiently far from the electric field (even if a portion of the stream before droplets break off is in the presence of an electric field), then charging will not occur.

The on demand type inkjet printers are covered by hundreds of patents and describe two techniques for droplet formation. At every orifice, (about 30 to 200 are used for a consumer type printer) a pressurization actuator is used to produce the ink jet droplet. The two types of actuators are heat and piezo materials. The heater at a convenient location heats ink and a quantity will phase change into a gaseous steam bubble and raise the internal ink pressure sufficiently for an ink droplet to be expelled to a suitable receiver. The piezo ink actuator incorporates a piezo material. It is said to possess piezo electric properties if an electric charge is produced when a mechanical stress is applied. This is commonly referred to as the "generator effect". "The converse also holds true; an applied electric field will produce a mechanical stress in the material. This is commonly referred to as the "motor effect". Some naturally occurring materials possessing these characteristics are quartz and tourmaline. Some artificially produced piezoelectric crystals are: Rochelle salt, ammonium dihydrogen phosphate (ADP) and lithium sulphate (LH). The class of materials used for piezo actuators in an ink jet print head possessing those properties includes polarized piezoelectric ceramics. They are typically referred to as ferroelectric materials. In contrast to the naturally occurring piezoelectric crystals, ferroelectric ceramics are of the "polycrystalline" structure. The most commonly produced piezoelectric ceramics are: lead zirconate titanate, barium titanate, lead titanate, and lead metaniobate. For the ink jet print head a ferroelectric ceramic is machined to produce ink chambers. The chamber is water proofed by gold plating and becomes a conductor to apply the charge and cause the piezo "motor effect". This "motor effect" causes the ink cavity to shrink, raise the internal pressure, and generate an ink droplet.

Inks for high speed jet droplet printers must have a number of special characteristics. Typically, water-based inks have been used because of their conductivity and viscosity range. Thus, for use in a jet droplet printer the ink must be electrically conductive, having a resistivity below about 5000 ohm-cm and preferably below about 500 ohm-cm. For good flow through small orifices water-based inks generally have a viscosity in the range between about 1 to 15 centipoise at 25 degree C.

Over and above this, the ink must be stable over a long period of time, compatible with the materials comprising the orifice plate and ink manifold, free of living organisms, and functional after printing. The required functional characteristics after printing are: smear resistance after printing, fast drying on paper and waterproof when dry. Examples of different types of water-based jet droplet printing inks are found in U.S. Pat. Nos. 3,903,034; 3,889,269; 3,870,528; 3,846,141; 3,776,642; and 3,705,043.

The ink also has to incorporate a nondrying characteristic in the jet cavity so that the drying of ink in the cavity is hindered or slowed to such a degree that through occasional spitting of ink droplets the cavities can be kept open. The addition of glycol will facilitate the free flow of ink through the ink jet. Ink jet printing apparatus typically includes an ink jet print head that is exposed to the various environments where ink jet printing is utilized. The orifices are exposed to all kinds of air born particles. Particulate debris accumulates on the surfaces, forming around the orifices. The ink will combine with such particulate debris to form an interference burr to block the orifice or cause through an altered surface wetting to inhibit a proper formation of the ink droplet. That particulate debris has to be cleaned from the orifice to restore proper droplet formation. This cleaning commonly is achieved by wiping, spraying, vacuum suction, and/or spitting of ink through the orifice. The wiping is the most common application.

Inks used in ink jet printers can be said to have the following problems:

1) they require a large amount of energy to dry after printing;
2) large printed areas on paper usually cockle because of the amount of water present;
3) the printed images are sensitive to wet and dry rub;
4) the compositions of the ink usually require an antibacterial preservative to minimize the growth of bacteria in the ink;
5) the inks tend to dry out in and around the orifices resulting in clogging;
6) the wiping of the orifice plate causes wear on plate and wiper;
7) the wiper itself generates particles that clog the orifice;
8) cleaning cycles are time consuming and slow the productivity of ink jet printers. It is especially of concern in large format printers where frequent cleaning cycles interrupt the printing of an image; and
9) when a special printing pattern is initiated to compensate for plugged or badly performing orifices, the printing rate declines.

Some of these problems may be overcome by the use of polar, conductive organic solvent based ink formulations. However, the use of non-polar organic solvents is generally precluded by their lack of electrical conductivity. The addition of solvent soluble salts can make such inks conductive, but such salts are often toxic, corrosive, and unstable.

SUMMARY OF THE INVENTION

These objects are achieved by an ink jet printer having an ink jet printer having a printhead defining a plurality of orifices for ejecting ink droplets. The printer comprises a source of cleaning fluid, a cleaning member having a surface partially dipped in the cleaning fluid, a first drive mechanism to move the cleaning member surface creating a flow of cleaning fluid on the surface and a second drive mechanism to advance the printhead and the cleaning member surface into a proximate and separate relation with the cleaning member surface wherein at least one of the orifices of the printhead enters the flow of cleaning fluid wherein the print head and the cleaning member surface are separated by gap of between 0.1 mm and 2.54 mm.

According to another aspect of the present invention, these objects of the invention are achieved by an inkjet printer having a printhead with a structure defining at least one ink drop ejection orifice and a liquid collection vessel adapted to contain a cleaning fluid. A roller is partially submerged in the cleaning fluid and a first actuator fixed to and rotating the roller to create a continuous flow of cleaning fluid about the roller. A second actuator variably positions the roller and the printhead between two separated positions, a distal position and a proximate position wherein at least one orifice of the printhead enters into the flow of cleaning fluid.

According to another aspect the objects of the present invention are met by an ink jet printer comprising a printhead defining at least one orifice for ejecting ink droplets and a source of cleaning fluid. A cleaning member having a surface is partially dipped in the cleaning fluid. A first drive mechanism is provided to move the cleaning member surface creating a flow of cleaning fluid on the surface and a second drive mechanism is provided to advance the printhead and the cleaning member surface into a proximate and separate relation with the cleaning member surface wherein at least one orifice of the printhead enters the flow of cleaning fluid. A computer operates the first drive mechanism and second drive mechanism to clean the print head using at least a normal cleaning mode and a high cleaning mode wherein the computer detects conditions indicating the extent of cleaning needed by the print head and changes cleaning modes based upon detected conditions.

ADVANTAGES OF THE INVENTION

Rapid cleaning of orifices in accordance with the present invention can be accomplished in such a short time because of the efficiency of cleaning apparatus in accordance with the present invention.

The cleaning fluid on the roller is replenished at a predetermined rate and removes waste ink and particulate debris permanently from the inkjet print head.

Another advantage of this invention is that the cleaning fluid on the roller can have a substantial thickness thereby minimizing the requirements for mechanical tolerances.

Another advantage of this cleaning technique is that with no mechanical rubbing, the wear of the delicate orifice plate is eliminated or greatly reduced. The replacement of the ink jet head will be less frequent and more of the orifices will stay functional to result in a higher image quality.

Another advantage is that individual inks can be cleaned by selecting the rotation rate of the roller to change the turbulence or agitation rate. In this way, the speed of the roller can be selected to match the cleaning needs of a particular ink. In other words, red, green, and blue inks in the same cartridge can have different roller speeds.

BRIEF DESCRIPTION OF THE DRAWINGS

FIG. 1 is a prior art cross sectional schematic view of a typical piezo electric inkjet print head;

FIG. 2 is a schematic showing an ink droplet exit orifice in the FIG. 1 structure and an elastomeric wiper blade commonly used for cleaning the orifice plate;

FIG. 3 the ink droplet as it begins to form in the orifice of FIG. 1;

FIG. 4 shows the ink droplet after formation with the orifice of FIG. 1;

DETAILED DESCRIPTION OF THE INVENTION

Figure 5:
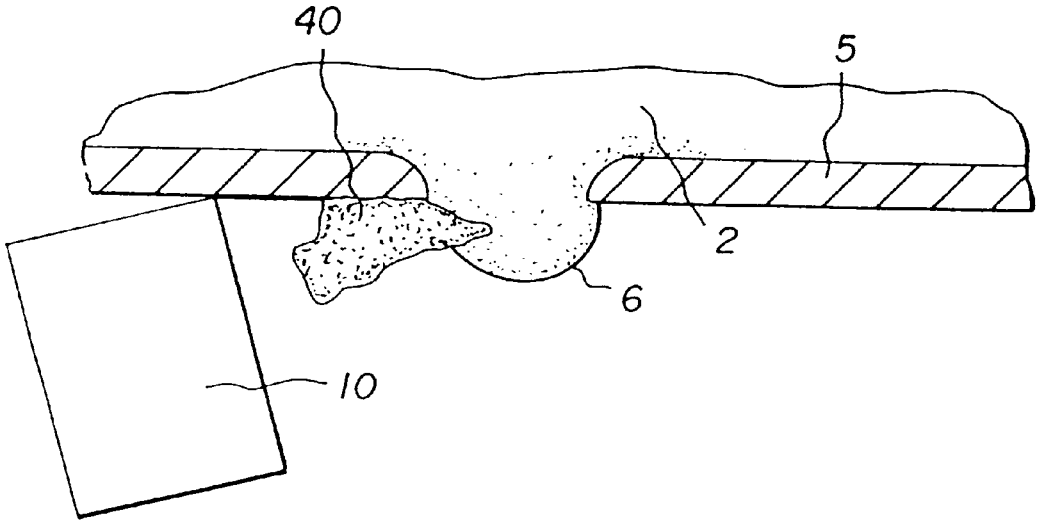
FIG. 5 shows the interference of the particulate debris with the formation of an ink droplet.

FIG. 1 shows a prior art cross sectional view of an inkjet print head 1. Orifices defining structures such as the depicted outlet plate 5 includes orifice 9 having a diameter "d" and can be manufactured by electro-forming or sheet metal fabrication methods. It will be understood that the outlet plate 5 actually includes a plurality of orifices for forming multiple ink droplets. The outlet plate 5 is glued to the piezo walls 3. Ink 2 is included in a pumping cavity 8. An inlet orifice 7 formed in an inlet plate 4 permits ink to be delivered to the pumping cavity 8. A meniscus 6 of ink is formed in the orifice 9.

FIG. 2 shows the outlet plate 5 with the ink outlet meniscus 6 and an elastomeric wiper blade 10 in contact with the outlet orifice plate. The blade is in position to wipe across the diameter "d" of the orifice 9 to clean any ink or other particulate debris that could interfere with the proper functioning of the ink jet print head 1.

FIG. 3 shows the meniscus 6 as it changes from an inward curve to an outward curve during the early stages before an actual ink droplet is manufactured. For reference and clarity the elastomeric wiper blade 10 and the outlet orifice plate 5 are also shown.

FIG. 4 shows the completed ink droplet 30, and its direction, which is indicated by the arrow "X". Also shown are (as often is the case when an ink droplet is formed) two ink droplet satellites 31. The formation of satellites 31 is chaotic and can incorporate any number of ink droplet satellites 31 from 0 up to 10. These numbers of satellites 31 have been observed. Note that the outlet meniscus 6 has returned to the original state.

FIG. 5 shows how a debris 40 can interfere with the meniscus 6 during the ink droplet formation. As the ink 2 touches the debris 40, the droplet formation can be completely stopped by the ink surface condition change, due to the presence of the debris 40. Again outlet orifice plate 5 and elastomeric wiper blade 10 are shown for clarity.

Figure 6:
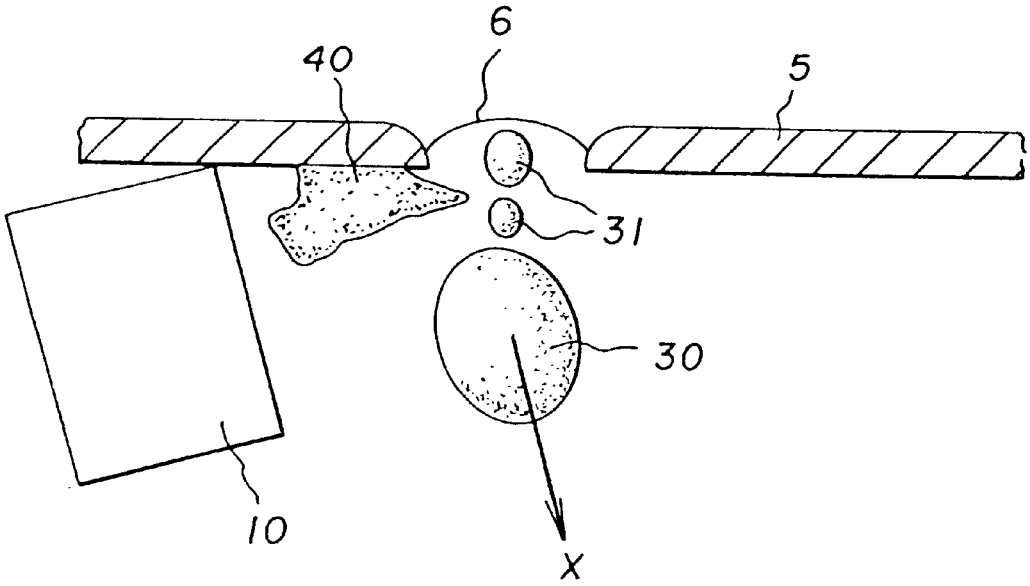
FIG. 6 shows that a particulate material can cause a change of direction of ink droplets.

FIG. 6 shows another defect caused by the presence of a debris 40. The direction of the droplet 30 with satellites 31 shown as "X" is changed and will result in a degradation of the image. Again outlet orifice plate 5 and elastomeric wiper blade 10 are shown for clarity. Note that the outlet meniscus 6 has returned to the original state but debris 40 can also interfere with that process.

Figure 7:
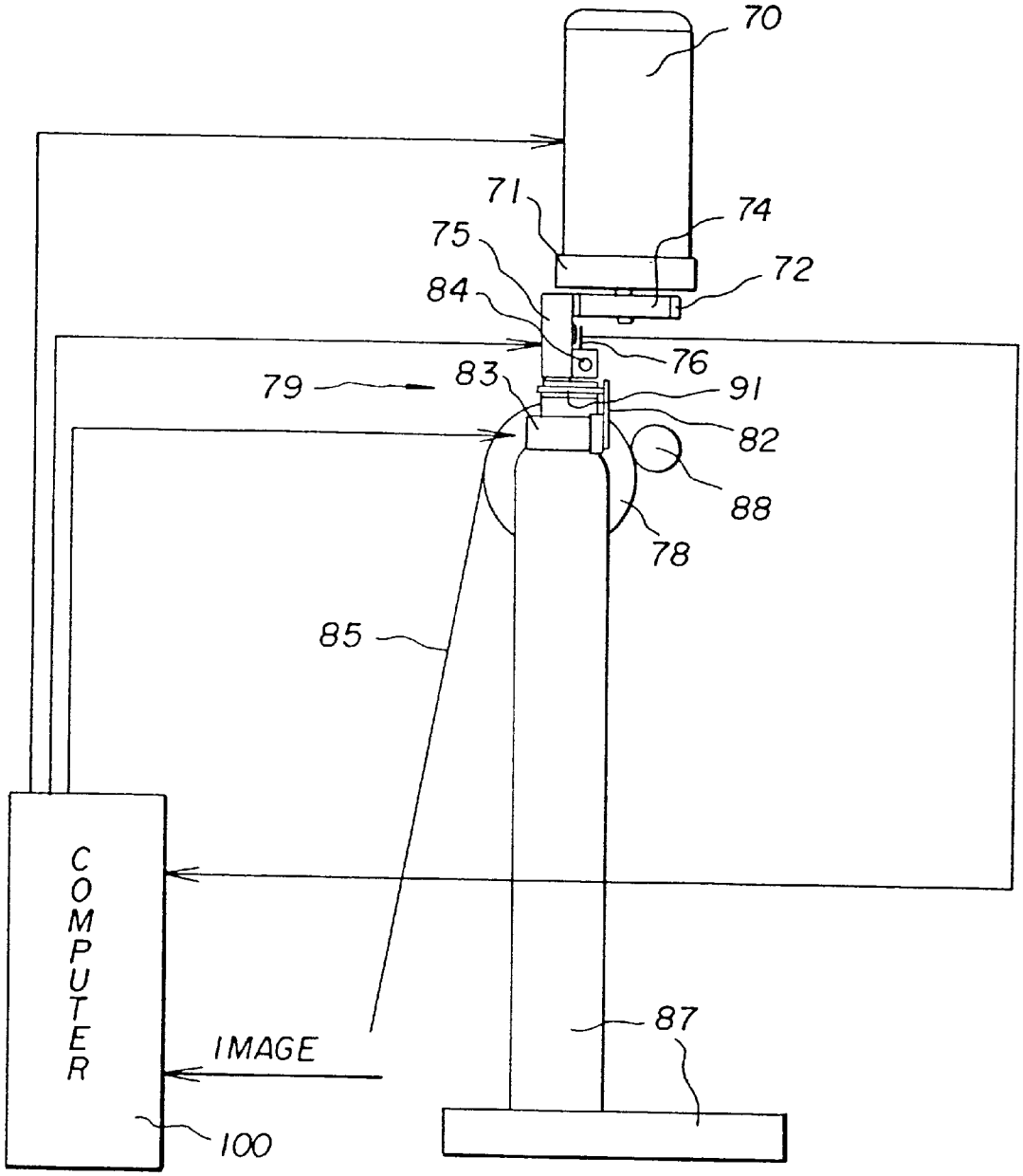
FIG. 7 shows a schematic of ink jet printing apparatus in accordance with the present invention which shows a print head and a cleaning station.

FIG. 7 shows an ink jet printing apparatus 79 in accordance with the present invention, an inkjet head 75, a drive motor 70 linked with a gearbox 71, an ink jet head belt drive wheel 74, and the ink jet head drive belt 72 to drive the ink jet head 75 back and for across the print paper 85. The ink jet droplets are controlled by the position of the inkjet head 75. This position is monitored by a position encoder strip 76 and the image input from computer 100. The same computer controls the ink jet print head 75, drive motor 70, the cleaning roller drive motor 83 which rotates at a desired velocity the cleaning roller 91. Also shown is the guide 84 for back and forth translation of the ink jet head 75. The inkjet generates an image 81 (shown in FIG. 8) on the print paper 85. The print paper 85 is supported by the platen roller 78 and registration of the paper is controlled by the capstan roller 88. Both rollers, platen 78 and capstan 88 are driven by a motor not shown and are controlled by the computer 100. Also shown is a cleaning roller 91 with the cleaning roller drive belt 82 connecting the cleaning drive motor 83 to the cleaning roller 91. A mounting structure 87 supports all the associated mechanism for the inkjet printer 79.

Figure 8:
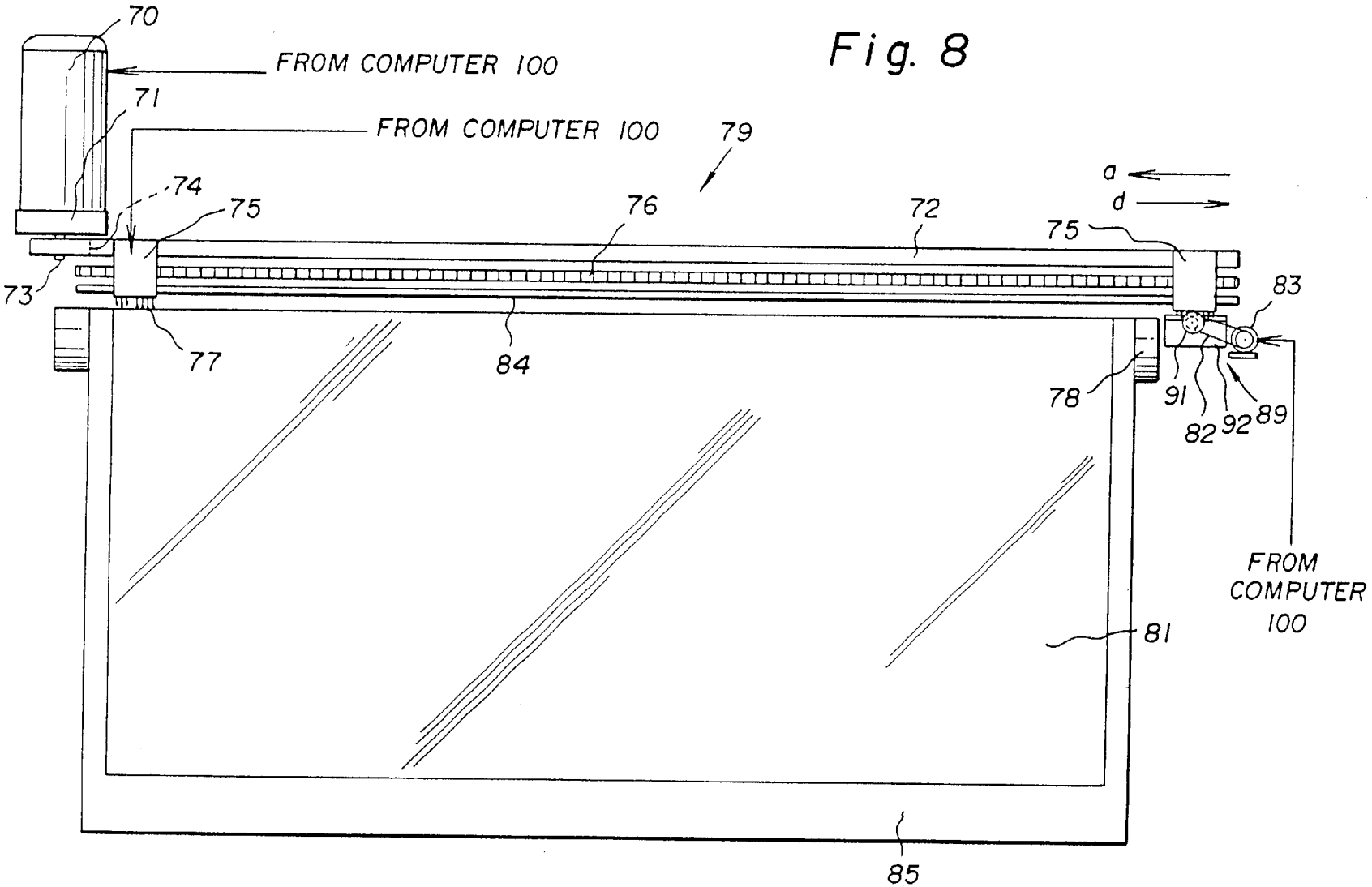
FIG. 8 shows the same as FIG. 7 but a different perspective for clarification of illustration.

FIG. 8 shows the same printer as FIG. 7 but in a 90 degree rotated position. It can now be visualized how the ink jet head 75 with ink droplets 77 move across the paper 85 driven by the ink jet print head drive motor 70, a gearbox 71 to match motor speed with print speed. An ink jet head drive belt 72 driven by the belt drive wheel 74 drives the ink jet print head 75 across the total width of the print paper 85. The position of the print head 75 is metered by the position encoder strip 76. At the right location determined by the computer 100 (shown in FIG. 7) and the encoder strip 76 an ink droplet 77 is deposited to form the image 81. When the inkjet print head 75 reaches the far end of the print paper 85 it de-accelerates in the indicated direction and distance of arrow "d". When reversing, indicated by the direction and distance of arrow "a", the print head 75 re-accelerates to the correct print speed. This turn around deceleration ("d") and re-acceleration ("a") time is used to accomplish the cleaning without added time for the ink jet print head 75. The cleaning station 89 is mounted at the far right side end of the ink jet printer 79 and consists of a cleaning fluid tank 92, a cleaning roller 91, cleaning roller drive motor 83, and a cleaning roller drive belt 82. A number of different cleaning fluids can be used in accordance with the present invention. For example, such fluids can include plain water, distilled water, alcohol or other water miscible solvents, and surfactants such as Zonyl, FSN (duPont). See also the disclosure of the above referenced commonly assigned U.S. Pat. No. 5,997,127 filed Sep. 24, 1998 entitled ADJUSTABLE VANE USED IN CLEANING ORIFICES IN INKJET PRINTING APPARATUS by Werner Fassler et al., the disclosure of which is incorporated herein by reference.

Figure 9:
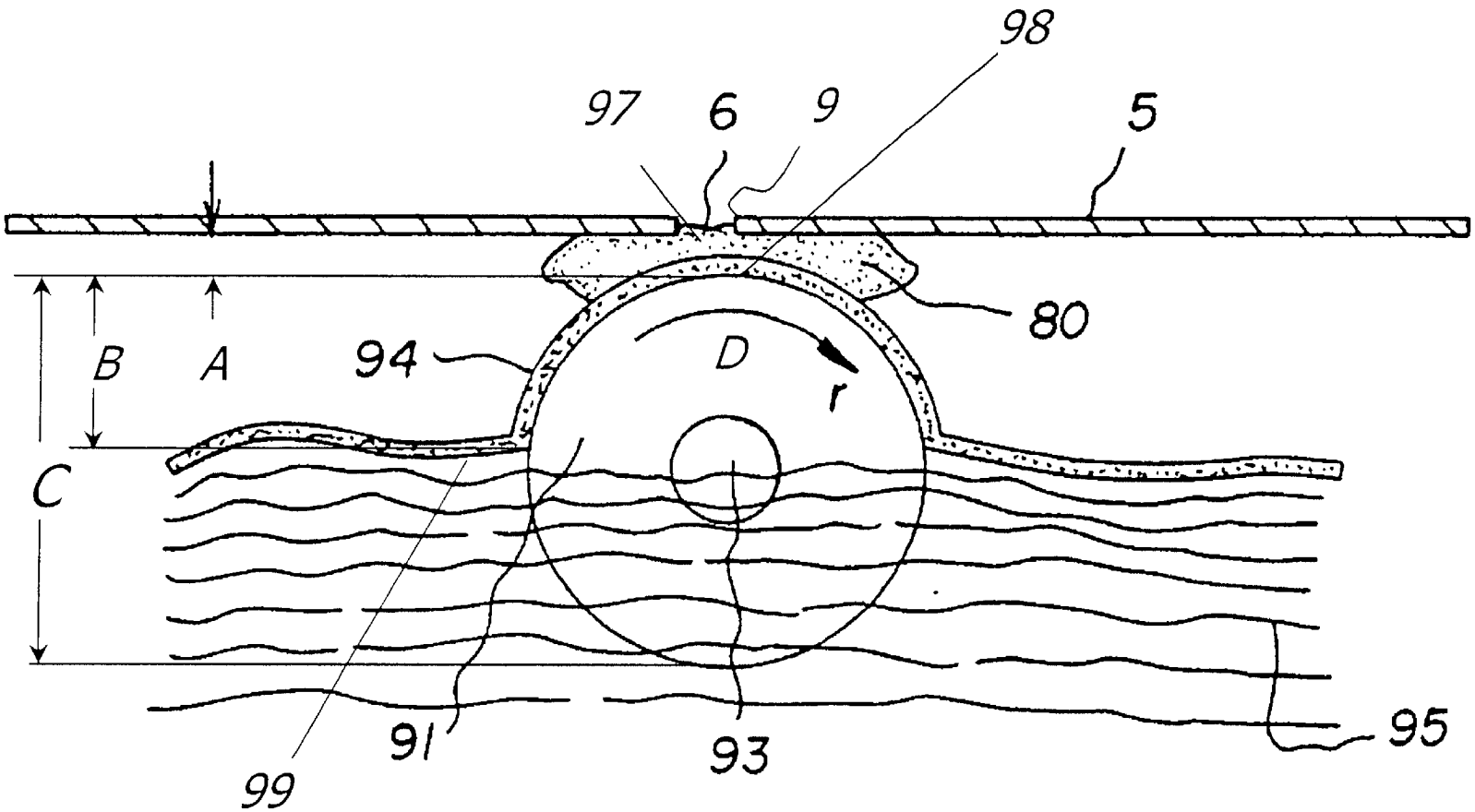
FIG. 9 shows the cleaning mechanism in accordance with the present invention.

FIG. 9 shows the rotating cleaning roller 91 mounted to a shaft 93 is partially submerged in the cleaning fluid and spaced from the structure defining the orifices 9. The cleaning roller 91, as it rotates, carries by surface tension a coating 94 of cleaning liquid 95 to the outlet orifice plate 5. The roller or the roller surface is made from a material which can be surface coated by the cleaning fluid. Such roller surface material can be selected from the group consisting of aluminum, teflon, polyvinyl chlorine, stainless steel, glass, and titanium. The liquid will fill the cleaning cavity 80. The liquid surface friction between the stationary outlet orifice plate 5 and the rotating cleaning roller 91 will cause a great amount of turbulence and liquid shearing to remove dirt and ink from the outlet orifice plate 5 in and near the orifices 6. An arrow marked "r" indicates one of the possible two the rotational direction of the cleaning roller 91.

It will be appreciated that the amount of turbulence that is applied by this system to clean contaminant from outlet orifice plate 5 and orifice 9 is a function of a number of factors. These factors include the width A of gap 97, the separation B between the roller top 98 and the surface 99 of cleaning fluid 95, the diameter C of cleaning roller 91, and the speed D of rotation of roller 91. Preferably, the width A of gap 97 is maintained between 0.1 mm and 2.54 mm. The distance B between the top surface 98 of cleaning fluid 95 and the top of roller 91 is preferably maintained at a separation distance that is no greater than 75% of the diameter of outer surface 96 of roller 91. The amount of turbulence to which orifice 6 and outlet orifice plate 5 are exposed can be increased by reducing the distance A and/or the distance B. The diameter C of roller 91 is preferably maintained in the range of 2.54 mm to 38.1 mm. The roller speed D is preferably maintained in the range of 250 to 2500 revolutions per minute. It will be appreciated that the amount of turbulence can be increased by increasing the diameter C of roller 91 and by increasing roller speed D. In a preferred embodiment of the present invention, the diameter C of roller 91 is 2.9 cm, the roller is rotated at a speed D of 1500 revolutions per minute, the distance A is 0.38 mm and the distance B between roller top 98 and fluid top surface 99 is 1.4 cm.

Figure 10:
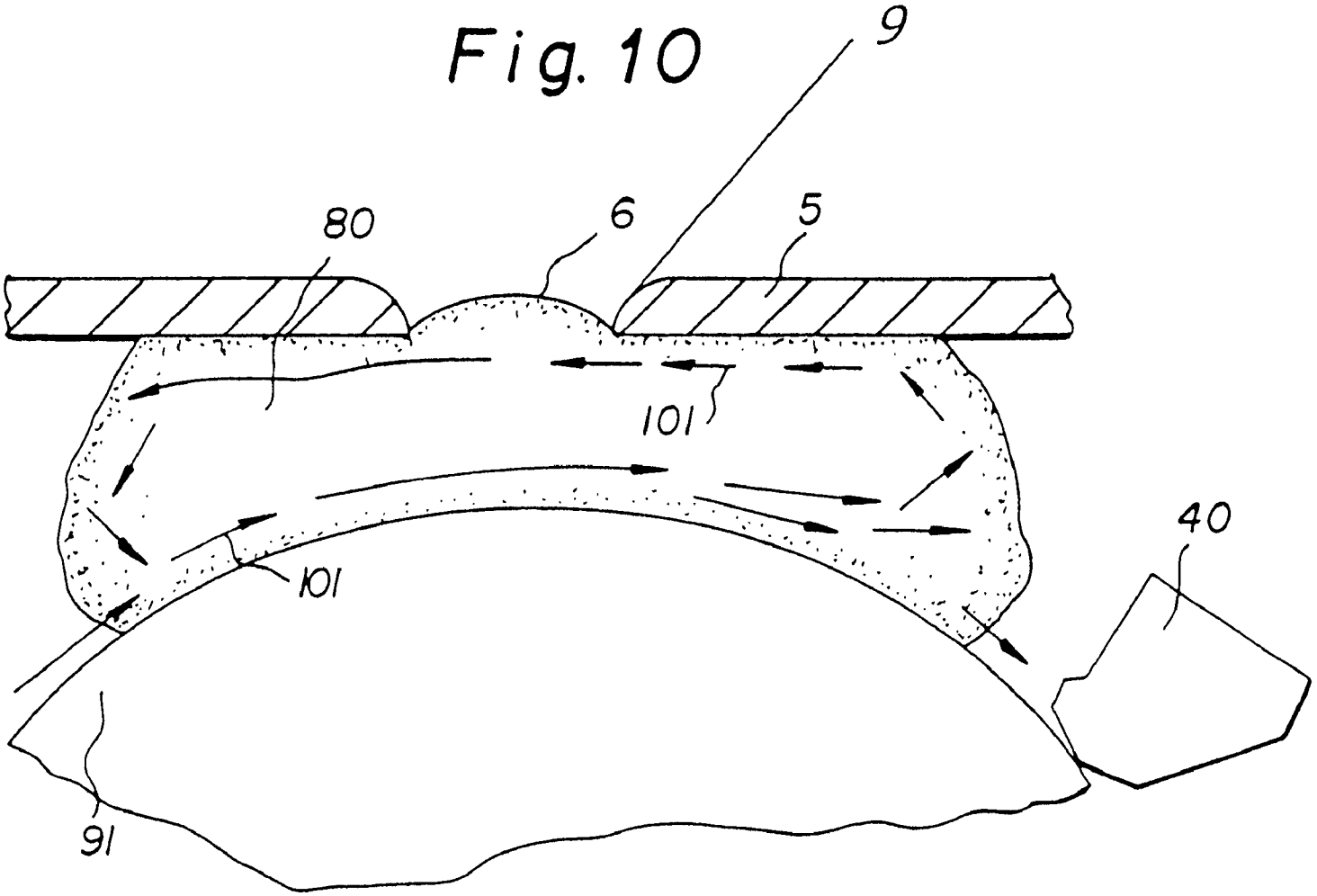
FIG. 10 shows an enlargement of the cleaning fluid coating depicting its turbulent counter clockwise flow.

FIG. 10 shows in an enlarged form of how the fluid friction shown by vectors 101 causes the flow of the cleaning fluid to shear dirt and other particles 40 permanently from the outlet orifice plate 5. The vectors 101 indicate the flow of fluid in the cleaning cavity 80 caused by surface friction of orifice plate 5 and cleaning roller 91.

Figure 11:
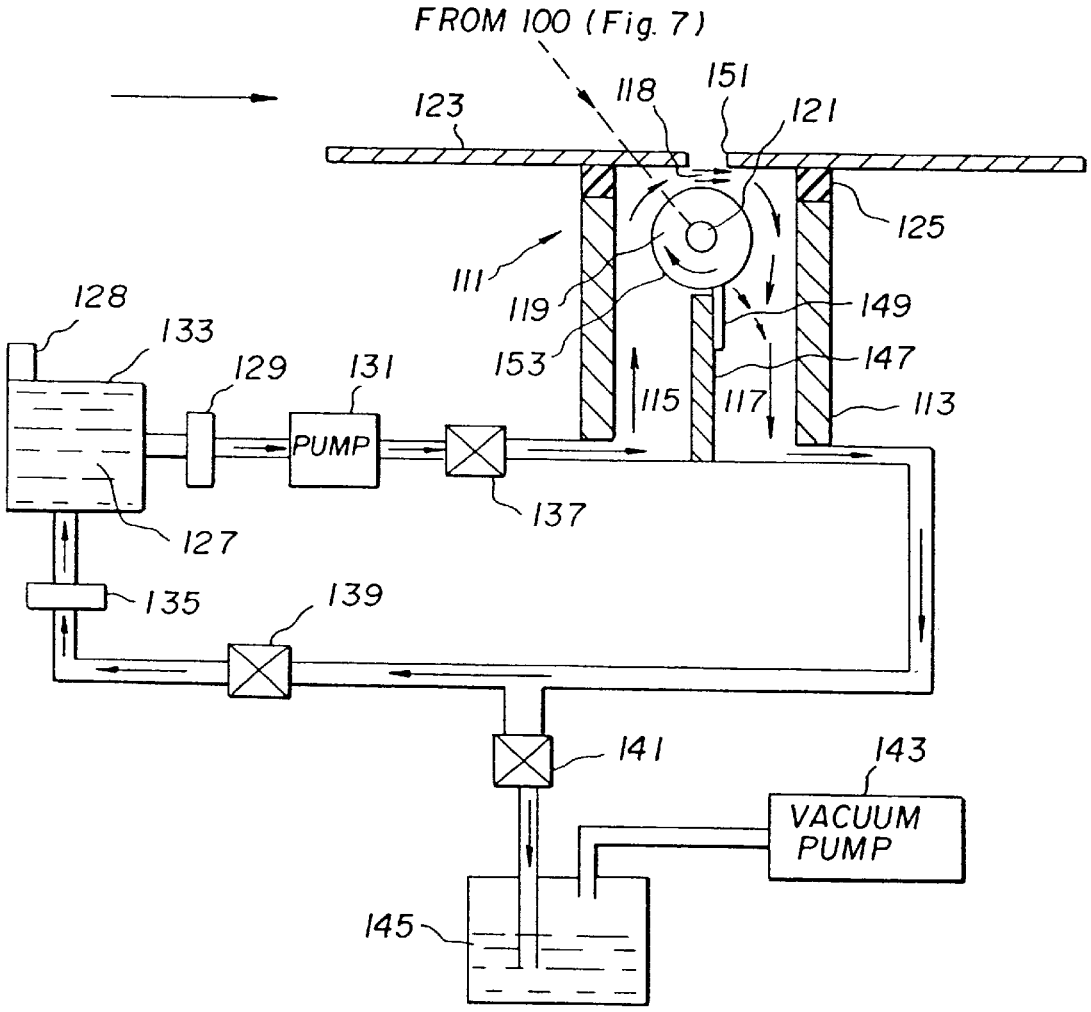
FIG. 11 shows a schematic view of another embodiment of the present invention, which depicts an ink jet print head and a head cleaning device.

FIG. 11 shows another embodiment of the invention cleaning an ink jet print head. The inkjet print head has moved (see arrows) from the print position (not shown) to a cleaning position. The head cleaning device 111 includes a cleaning fluid collection vessel 113, cleaning fluid supply 115 and exit 117 channels, and a rotating cleaning roller 119 mounted onto a shaft 121. A wall 147 separates the channels 115 and 117. Cleaning head 111 is brought into contact with outlet orifice plate 123 and a leak-proof seal is created by elastomer 125 at bottom of cleaning head 111. The outlet orifice plate 123 has a plurality of orifices of which only one orifice 151 is shown. Cleaning fluid 127 is pumped from cleaning fluid reservoir 133 into cleaning fluid supply channel 115 (by pump 131 with valves 137 and 139 in the open position and valve 141 in the closed position). Cap and vent 128 is provided on the reservoir 133. The head cleaning device 111 is substantially filled with cleaning fluid 127. Cleaning roller 119 (driven by computer 100 shown in FIG. 7) is rotated at the desired rotation rate. The rotation of the cleaning roller creates shear forces in the gap 118, thus producing a cleansing/scrubbing action capable of dislodging particles and/or debris accumulating around ink jet orifices. The size of gap 118 is controlled by the location of the cleaning roller, the diameter of the cleaning roller and the thickness of the elastomer seal 125. The dislodged debris is carried away by the cleaning fluid exiting in exit channel 117. However, particles and fibers may adhere to rotating cleaning roller 119, in which case the contaminated rotating cleaning roller 119 will most likely abrade outlet orifice plate 123. In order to minimize this, a scraper blade 149 attached to the roller end of wall 147 and in contact with cleaning roller 119 removes particles adhering to the roller and also prevents particles form entering the supply channel 115. It is preferred but not necessary that the scraper be flexible and in contact with cleaning roller 119. The exiting cleaning fluid preferably is re-circulated. A filter 129 interposed between the cleaning fluid reservoir 133 and pump 131 ensures that cleaning fluid entering the supply channel 115 is free of particles and fibers. A second filter 135 is also preferably used to filter cleaning fluid from exit channel 117 before entering reservoir 133. The cleaning fluid is fed into device 111 at a steady rate by pump 131. At a desired time, pump 131 is turned off and valve 139 is closed. Valve 137 (a 3-way valve) is positioned so that it is open to atmosphere only. Vacuum pump 143 is activated and valve 141 is opened to suck trapped cleaning fluid between valves 137 and 139 into collection receptacle 145. This operation prevents spillage of cleaning fluid when the device 111 is detached from outlet orifice plate 123. Further, the outlet orifice plate 123 is substantially dry, permitting the ink jet print head to function without impedance from liquid drops around the orifices. Cleaning fluid in collection receptacle 145 may be poured back into cleaning fluid reservoir 133 or can be pumped back into cleaning fluid reservoir 133 (pump and piping is not shown).

Although the cleaning roller surface 153 is shown spaced from the plate 123, it can be in direct contact with plate. In such a case the roller surface 153 should be formed of a soft absorbent material such as porous elastomeric material which can carry cleaning fluid 127. In this case it is preferable that the scraper blade 149 presses against the roller surface 153 so that cleaning fluid and debris is squeezed out of the porous roller surface 153. For this purpose, it is preferable that the scraper blade 149 be constructed out of a stiff material made of plastic.

It is understood that the device 111 would function without wall 147 and scraper blade 149. In this case however, channels 115 and 117 would be combined to create one chamber with an inlet and an out let for the cleaning solution. This modification to head cleaning device 111 is not shown. The head cleaning device 111 will also function if the device is primed with cleaning fluid and connected to a cleaning fluid reservoir. When the cleaning roller rotates, cleaning fluid is siphoned from cleaning solution reservoir and pumped through device 111. The cleaning roller therefore has a dual function in that it cleans the outlet orifice plate 123 and also acts as a pump. This embodiment is not shown. The device 111 may also be configured to utilize a variety of cleaning fluids by incorporating appropriate valves and plumbing (not shown).

It will also be understood that printing conditions can vary and, accordingly, the degree of cleaning that is required to remove contaminant from the print head can vary. In certain circumstances conditions may indicate that a normal cleaning mode will suffice. However, under extreme conditions, for example where a print head has not been operated for a long period of time, a high level of cleaning may be required. Similarly, it is known that certain colors and types of inkjet inks are more likely to adhere to outlet plate 5 and orifice 9 and therefore be more difficult to remove. The print head cleaning structure described in the various embodiments of the present application can be operated at variable levels of cleaning efficiency.

In this regard, computer 100 is adapted to detect conditions indicating the extent of cleaning, to change cleaning modes based upon the detected conditions, and to operate the first drive mechanism and second drive mechanism to clean outlet plate 5 and orifice 9 in one of a normal cleaning mode or a high cleaning mode. One example of a condition that can be used by computer 100 to select a level of cleaning is the elapsed time between the last use of the print head. Where, for example, the print head was last used 20 days ago, a high cleaning mode may be selected because of the increased probability that ink will be dried to the print head. However, where the print head was used a few moments or hours earlier, normal printing mode can be selected. Similarly, where an ink that is known to have fast drying properties or other characteristics that make it difficult to remove the ink from the output orifice plate 5 and orifice 9, the high cleaning mode may be selected.

Figure 12:
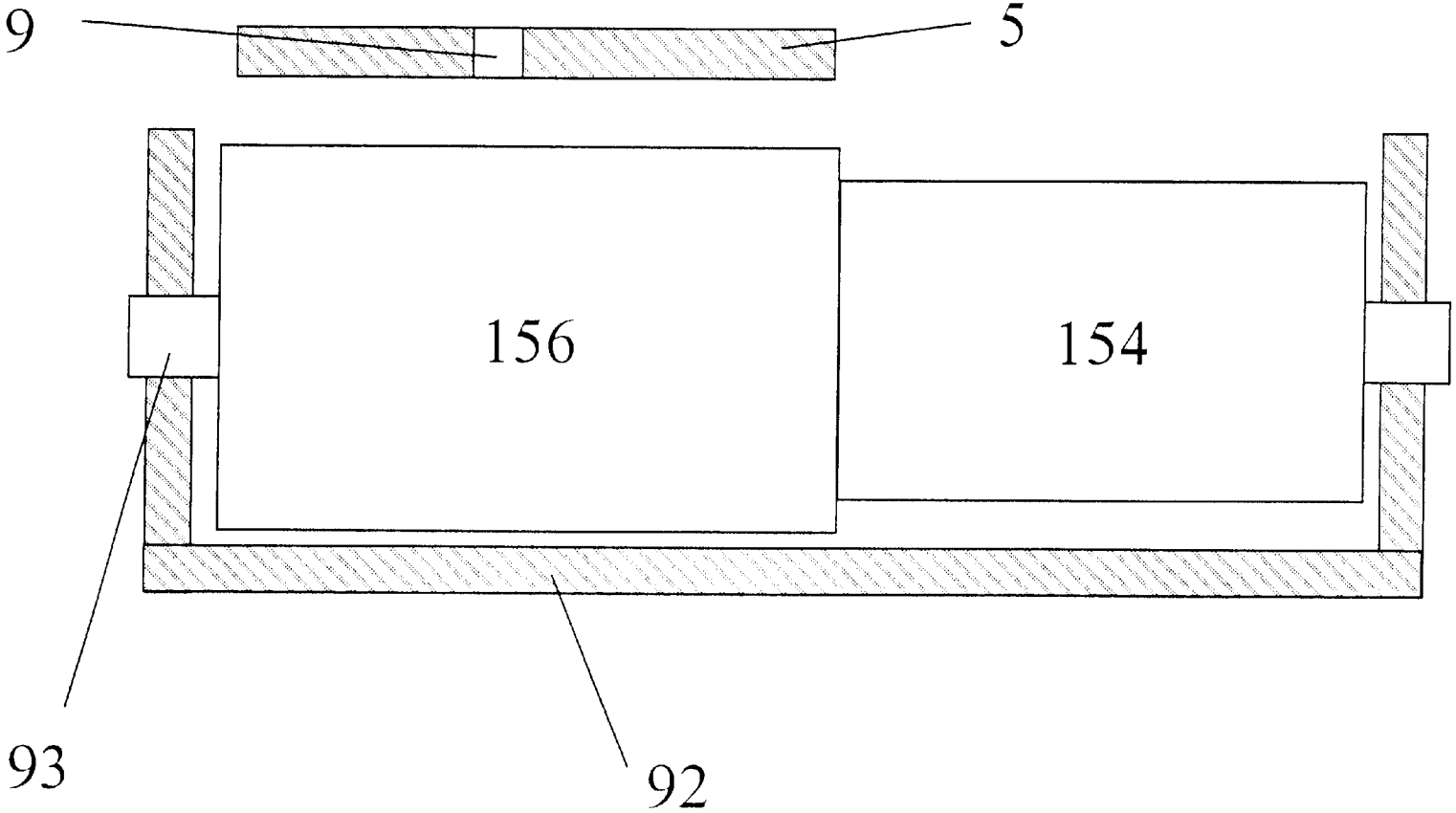
FIG. 12 shows a view of a roller having a first surface area and a second surface area for cleaning in more than one mode.

The computer 100 can be used to adapt the operation of the printer of the present invention to perform cleaning in the normal mode or the high mode. This can be done by adjusting the width A of gap 97, the separation B between the roller top 98 and the surface 99 of cleaning fluid 95, the diameter C of cleaning roller 91, and the speed D of rotation of roller 91. Further, computer 100 can selectably reverse the direction of rotation of roller 91 to create additional turbulence. As is shown in FIG. 12, roller surface 91 can also be adapted with a first surface area 154 having a first diameter C1 and a second surface area 156 having a different diameter C2. In this embodiment, computer selectively confronts the outlet plate 5 and orifice 9 with the first surface area 154 during normal cleaning and the second surface area 156 during high cleaning mode.

It is also understood that the efficiency of the cleaning system of the cleaning system described herein is a function of the force applied to the surface of the print head to remove cleaning fluid from the surface. This force is created by fluid pressure that is applied at the surface of the print head. Thus, to increase the efficiency at which contaminants are removed from the surface of the print head, it is important to increase the fluid pressure applied at the surface of the print head.

The invention has been described in detail, with particular reference to certain preferred embodiments thereof, but it should be understood that variations and modifications can be effected with the spirit and scope of the invention.

PARTS LIST

| | |
|---|---|
| 1 | ink jet print head |
| 2 | ink |
| 3 | piezo material |
| 4 | inlet plate |
| 5 | outlet plate |
| 6 | outlet meniscus |
| 7 | inlet orifice |
| 8 | pumping cavity |
| 9 | outlet orifice |
| 10 | elastomeric wiper blade |
| 30 | ink droplet |
| 31 | satellite |
| 40 | debris as particles |
| 70 | ink jet head drive motor |
| 71 | gearbox |
| 72 | ink jet head drive belt |
| 74 | drive wheel |
| 75 | ink jet head |
| 76 | encoder strip |
| 77 | ink droplets |
| 78 | platen roller |
| 79 | ink jet printer |
| 80 | cavity space |
| 81 | image |
| 82 | cleaning roller drive belt |
| 83 | cleaning roller drive motor |
| 84 | guide |
| 85 | print paper |
| 87 | mounting structure |
| 88 | capstan roller |
| 89 | cleaning station |
| 91 | cleaning roller |
| 92 | cleaning fluid tank |
| 93 | shaft |
| 94 | surface coating |
| 95 | cleaning fluid |
| 97 | gap |

-continued

PARTS LIST

| | |
|---|---|
| 98 | roller top |
| 99 | surface of cleaning fluid |
| 100 | computer |
| 101 | vectors |
| 111 | head cleaning device |
| 113 | cleaning fluid collection vessel |
| 115 | cleaning fluid supply channel |
| 116 | cleaning fluid exit channel |
| 117 | exit channel |
| 118 | gap |
| 119 | rotating cleaning roller |
| 121 | shaft |
| 123 | outlet orifice plate |
| 125 | elastomer |
| 127 | cleaning fluid |
| 128 | cap and vent |
| 129 | first filter |
| 131 | pump |
| 133 | cleaning fluid reservoir |
| 135 | second filter |
| 137 | first valve, 3-way valve |
| 139 | second valve |
| 141 | third valve |
| 143 | vacuum pump |
| 145 | collection receptacle |
| 147 | wall |
| 149 | scraper blade |
| 151 | orifice |
| 153 | cleaning roller surface |
| 154 | first area |
| 156 | second area |
| A | gap width |
| B | separation between roller top and cleaning fluid surface |
| C | diameter of roller outer surface |
| D | speed of rotation |

What is claimed is:

1. An ink jet printer comprising:

a printhead defining a plurality of orifices for ejecting ink droplets, a source of cleaning fluid;

a cleaning member having a surface partially dipped in the cleaning fluid;

a first drive mechanism to move the cleaning member surface creating a flow of cleaning fluid on the surface; and a second drive mechanism to advance the printhead and the cleaning member surface into a proximate and separate relation with the cleaning member surface wherein at least one of the orifices of the printhead enters the flow of cleaning fluid;

wherein the print head and the cleaning member surface are separated by gap of between 0.1 mm to 2.54 mm.

2. The ink jet printer of claim 1 wherein the cleaning member surface comprises a roller.

3. The ink jet printer of claim 2 wherein the roller has an outer surface having a radius of between 2.54 mm and 38.1 mm.

4. The ink jet printer of claim 2 wherein the cleaning fluid has a top surface and the roller has an outer surface having a radius and a top end that is proximate to the printhead and wherein the top end of the outer surface of the roller is separated from the top surface of the cleaning fluid by a distance that is equal to or less than 75% of the roller diameter.

5. The ink jet printer of claim 2 wherein the cleaning member is a roller that is rotated by first drive mechanism at a rate between 250 and 2500 revolutions per minute.

6. The ink jet printer of claim 2, wherein the roller has an outer surface with a first portion having a first radius and with a second portion having a second radius.

7. An ink jet printer comprising:

a printhead having a structure defining at least one ink drop ejection orifice;

a liquid collection vessel adapted to contain a cleaning fluid;

a roller partially submerged in the cleaning fluid;

a first actuator fixed to and rotating the roller to create a continuous flow of cleaning fluid about the roller; and a second actuator to variably position the roller and the printhead between two separated positions, a distal position and a proximate position wherein at least one orifice of the printhead enters into the flow of cleaning fluid, wherein the print head and the roller are separated by a gap of between 0.1 mm and 2.54 mm when the print head and the roller are in the proximate position.

8. The ink jet printer of claim 7 wherein the roller has a radius of between 2.54 mm and 38.1 mm.

9. The inkjet printer of claim 7 wherein the cleaning fluid has a top surface and the roller has an outer surface having a radius and a top end that is proximate to the printhead and wherein the top end of the outer surface of the roller is separated from the top surface of the cleaning fluid by a distance that is equal to or less than 75% of the roller diameter.

10. The inkjet printer of claim 7 wherein the roller is rotated at a rate between 250 and 2500 revolutions per minute.

11. The ink jet printer of claim 7, wherein the print head and the roller are separated by a gap of between 0.1 mm and 2.54 mm.

12. The ink jet printer of claim 7, wherein the roller has a first portion having a first radius and with a second portion having a second radius.

13. An ink jet printer comprising:

a printhead defining at least one orifice for ejecting ink droplets;

a source of cleaning fluid;

a cleaning member having a surface partially dipped in the cleaning fluid;

a first drive mechanism to move the cleaning member surface creating a flow of cleaning fluid on the surface;

a second drive mechanism to advance the printhead and the cleaning member surface into a proximate and separate relation with the cleaning member surface wherein at least one orifice of the printhead enters the flow of cleaning fluid; and a computer operating the first drive mechanism and second drive mechanism to clean the print head using at least a normal cleaning mode and a high cleaning mode wherein the computer detects conditions indicating the extent of cleaning needed by the print head and changes cleaning modes based upon detected conditions.

14. The printer of claim 13, wherein the print head and the cleaning member are separated by a first distance when in the normal cleaning mode and wherein the print head and cleaning member are separated by a second distance when in the high cleaning mode.

15. The printer of claim 14, wherein the second distance is shorter than the first distance.

16. The printer of claim 13, wherein the cleaning member is moved at a first rate during normal cleaning mode and wherein the cleaning member is moved at a second rate during high cleaning mode.

17. The printer of claim 16, wherein the second rate of movement is faster than the first rate of movement.

18. The printer of claim 13 wherein the cleaning fluid has a top surface and wherein the cleaning member comprises a roller and the roller has an outer surface having a radius and a top end that is proximate to the printhead and wherein the top end of the outer surface of the roller is separated from the top surface of the cleaning fluid by a first distance when in the normal cleaning mode and a second distance when in the high cleaning mode.

19. The printer of claim 18 wherein the second distance of separation between the top end of the roller and the top surface of the cleaning fluid is smaller than the first distance of separation between the top end of the roller and the top surface of the cleaning fluid.

20. The printer of claim 13, wherein the cleaning member comprises a roller having an outer surface with a first portion having a first radius and with a second portion having a second radius.

21. The printer of claim 20 wherein the print head is cleaned by a flow of cleaning fluid on the first portion of the roller when in the normal cleaning mode and wherein the print head is cleaned by a flow of cleaning fluid on the second portion of the roller when in the high cleaning mode.

22. The printer of claim 13, wherein the computer detects portions of the print head that require high cleaning cleans only those portions of the printhead at a high cleaning mode.

23. The printer of claim 13, wherein the computer detects the elapsed time between print head use and uses this elapsed time to select between high cleaning mode and normal cleaning mode.

24. The printer of claim 13, wherein the computer detects the type of ink used by the print head and the type of ink to select between high cleaning mode and normal cleaning mode.

25. A cleaning device for a print head, the cleaning device comprising:

a cleaning head having a cleaning fluid supply and a cleaning fluid exit channel with the cleaning fluid supply channel and the cleaning fluid exit channel partially separated by a wall, and the cleaning head further defining an outer body having a cleaning orifice;

a roller positioned partially in the cleaning fluid supply channel and partially in the cleaning fluid exit channel, with the roller aligned with but separated from the cleaning orifice;

a first drive member to position the cleaning head so that the cleaning orifice forms a seal with the print head and a gap between the roller and the print head;

a pressurized supply of cleaning fluid to fill the cleaning fluid supply channel with cleaning fluid when the seal is formed with the print head;

a scraper blade connected at a first end to the wall and contacting at a second end the roller to remove cleaning fluid from the roller;

a second drive member rotating the roller to accelerate a flow of cleaning fluid from the cleaning fluid supply channel through the cleaning orifice to the cleaning fluid exit channel with the flow filling the gap and cleaning the print head.

26. The cleaning device of claim 25, wherein the pressurized supply of cleaning fluid comprises a pump to removes cleaning fluid from the exit channel and transfers the cleaning fluid wherein said pressurized supply of cleaning fluid further comprises a filter to filter the cleaning fluid as it passes from the cleaning fluid exit channel to the cleaning fluid supply channel.

27. The cleaning device of claim 25, wherein the gap between the print head and the roller is between 0.1 mm to 2.54 mm.

28. The cleaning device of wherein 25 wherein the roller is rotated at a rate between 250 and 2500 revolutions per minute.

* * * * *